US008356365B2

(12) United States Patent
Wolfson

(10) Patent No.: US 8,356,365 B2
(45) Date of Patent: Jan. 22, 2013

(54) FEETY GROW SLEEPY

(75) Inventor: Jodi Sue Wolfson, Far Rockaway, NY (US)

(73) Assignee: Jodi Sue Wolfson, Rockaway, NY (US)

( * ) Notice: Subject to any disclaimer, the term of this patent is extended or adjusted under 35 U.S.C. 154(b) by 213 days.

(21) Appl. No.: 12/805,275

(22) Filed: Jul. 21, 2010

(65) Prior Publication Data

US 2011/0030117 A1 Feb. 10, 2011

(51) Int. Cl.
*A41D 11/00* (2006.01)
*A41B 13/08* (2006.01)

(52) U.S. Cl. ..... 2/80; 2/111; 2/269

(58) Field of Classification Search ..... 2/75, 80, 2/111, 409, 239, 61, 83, 242, 269
See application file for complete search history.

(56) References Cited

U.S. PATENT DOCUMENTS

| | | | | | |
|---|---|---|---|---|---|
| 1,393,900 | A | * | 10/1921 | Milkes | 2/83 |
| 2,131,898 | A | * | 10/1938 | Milkes | 2/83 |
| 2,227,751 | A | * | 1/1941 | Idelman | 2/69.5 |
| 2,636,287 | A | * | 4/1953 | Heilbronner | 36/9 R |
| 2,655,660 | A | * | 10/1953 | Racz | 2/83 |
| 2,705,326 | A | * | 4/1955 | Lahnstein et al. | 2/83 |
| 2,705,804 | A | * | 4/1955 | Walker | 2/83 |
| 2,738,512 | A | * | 3/1956 | Winer | 2/80 |
| 3,111,676 | A | * | 11/1963 | Artzt et al. | 2/80 |
| 3,166,762 | A | * | 1/1965 | Winkworth | 2/80 |
| 3,201,800 | A | * | 8/1965 | McHugh | 2/83 |
| 3,381,311 | A | * | 5/1968 | Wormser | 2/270 |
| 3,555,567 | A | * | 1/1971 | Owen | 2/69.5 |
| 4,149,275 | A | * | 4/1979 | Sanchez | 2/269 |
| 4,181,982 | A | * | 1/1980 | Segovia | 2/239 |
| 4,475,253 | A | * | 10/1984 | Laveckis | 2/269 |
| 4,608,719 | A | * | 9/1986 | Lunt | 2/114 |
| 5,023,952 | A | * | 6/1991 | Palmer | 2/69 |
| 5,067,179 | A | * | 11/1991 | Wormser | 2/269 |
| 5,117,507 | A | * | 6/1992 | Long | 2/158 |
| 5,125,117 | A | * | 6/1992 | Buenos et al. | 2/239 |
| 5,539,932 | A | * | 7/1996 | Howard | 2/269 |
| 5,638,561 | A | * | 6/1997 | Sperry et al. | 5/485 |
| 5,878,437 | A | * | 3/1999 | Pater | 2/69 |
| 6,408,439 | B1 | * | 6/2002 | Garforth-Crippen | 2/80 |
| 6,694,522 | B1 | * | 2/2004 | Neal | 2/114 |
| 7,533,424 | B2 | * | 5/2009 | Symonds-Powell | 2/239 |
| 7,971,272 | B2 | * | 7/2011 | Bailey et al. | 2/80 |
| 2010/0299802 | A1 | * | 12/2010 | Bailey et al. | 2/70 |

* cited by examiner

*Primary Examiner* — Alissa L Hoey

(57) ABSTRACT

A sleeping garment for toddlers that adjusts via a hook and loop connection at one flap per each of the feet to accommodate for the child's growth to extend the usability of the garment for that child as well as to preserve it for subsequent children as a "hand-me-down." The hook portions are flaps of fabric located at the bottom of the toes and the hook is folded upward to the loops located at the top of the feet to adjust to the rapidly growing size of the child's feet. There are five claims submitted with seven drawings.

1 Claim, 8 Drawing Sheets

FEETY GROW SLEEPY

BACKGROUND OF THE INVENTION

1. Field of the Invention

This invention relates to children's sleeping garments to accommodate for that portion most often the first area to be outgrown, which are the feet. Children's clothing is one of the most expensive aspects of child rearing, particularly when the life expectancy of the article of clothing is not dictated by durability but rather by fit. In these tough economic times, families can save money by extending the life of the garment so that it can even be handed down to the next siblings. There is a problem, though with handing down the type of sleepwear with foot coverings attached all in one piece known as "footies." Since the child's foot grows faster than the rest of the body, parents often extend the life of the garment by cutting off the foot coverings. The child is able to wear the garment for a significantly longer period of time without the "footies," but the fabric frays at the cut site, rolls up, and looks unattractive. Also, when passed to the next toddler, the feet are missing so the garment is not as functional as it was before.

Feety Grow Sleepy addresses this problem by allowing the garment to expand with the growing feet so that the foot covering can remain intact for the next child's use. The easiest way to provide for this expansion system is to utilize the hook and loop material, known as VELCRO® as described in U.S. Pat. No. 2,717,437 to Mestral.

2. Description of the Prior Art

The most similar patents in the field of this invention are: (1) U.S. Pat. No. 5,170,505 to Rohrer, who invented an adjustable children's garment utilizing three flap hook and loop mechanisms on the legs, arms, waist and shoulders of the garments; and (2) U.S. Pat. No. 6,684,407 to St. Pierre, who invented an integral sock foot sewn directly to the sleeper instead of a traditional fabric constructed sock, which was made of stretchable material and is sized and shaped to contract into a snug and tight manner around the child's foot rather than loosely surrounding the foot.

IMPROVEMENTS OVER PRIOR ART (1) U.S. Pat. No. 5,170,505 to Rohrer

Ms. Rohrer's invention was an improvement upon U.S. Pat. No. 4,677,699 to Barabe, which utilized a waistband adjustment for adult garments to accommodate for weight loss or gain. Similarly, U.S. Pat. No. 4,985,936 to Jones utilized VELCRO® strips on men's formal wear to adjust for length. U.S. Pat. No. 4,051,854 to Aaron discloses diaper adjustments for babies utilizing a hook and loop type mechanism.

Other devices disclose the use of VELCRO® as a means of converting garments from one form to another form. U.S. Pat. No. 4,006,495 to Jones discloses an adult coat garment that has a semi-detachable sleeve wherein a coat can be converted to a vest. The sleeves of Jones' invention, however, are merely detachable, with no means of providing adjustment for growth.

U.S. Pat. No. 4,104,742 to Rahaim discloses an adult's convertible short pants and skirt garment that uses VELCRO® as a means of temporarily securing the garment in various configurations. In particular this garment is made so as to function as a skirt in one configuration and a pair of shorts with a crotch in the second configuration. Again, as with the Jones patent, there is no provision for adjustments to be made to accommodate human growth for various sizes.

U.S. Pat. No. 4,718,122 to Steverson discloses an adult convertible garment wherein a raincoat can be converted to a car length coat or a coat may be converted to a coverall garment. The principal means of connecting the various parts of the convertible garment are via VELCRO® connectors. As with other prior art garments, this invention lacks adjustments to accommodate growth.

U.S. Pat. No. 4,639,946 to Koenig discloses a child-restraining garment with a detachable bib. The purpose of the garment is to secure a small child or infant to a high chair while the child is eating. The Koenig garment uses VELCRO® as a means of providing child restraint but fails to provide the degree of adjustability required for child growth.

While Ms. Rohrer's invention was the first garment to accommodate the growing child, it would not be practical as sleepwear. The three flap hook and loop mechanism is bulky, cumbersome, and uncomfortable for the tender skin of a toddler. The placements of the devices throughout the garment would make it difficult to sleep because the bulk of the flaps would compress the skin of the shoulders, arms and legs; the movements of the resting child would cause the device to rustle, which might be loud enough to wake the child; and the devise failed to consider the use of "footies" which is preferred by parents to keep little feet warm through the night and to provide some traction for the toddling child.

This present invention's novelty is that it claims a new way to adjust for the toddler's rapidly growing feet so that the life of the garment can be extended for that child as well as for subsequent siblings. The footies will no longer have to be cut out to extend the life of the garment and thus functionality is maintained when the garment is handed down intact.

(2) U.S. Pat. No. 6,684,407 to St. Pierre

Mr. St. Pierre's invention was an improvement upon the conventional footed sleeper which first appeared in 1897 as a nightrobe with an attached foot pocket in U.S. Pat. No. 587,910 to Arnold, and evolved through 1968 when the foot portion of a child's footed sleeper was made more durable and slip resistant in U.S. Pat. No. 3,653,074 to Nobile and Jacobs. Mr. St. Pierre's 2002 version was an improvement in that a sock-like material, which was a separate type of fabric from the body of the garment, was utilized in order to adhere to the feet in a more form-fitting fashion.

While Mr. St. Pierre's version solved a problem of ill-fitting footies, it created another problem of increased costs to manufacturers because two different fabrics have to be used and then the footies must be sewn onto the garment.

The present invention's novelty arises from the ability to grow with the child while reducing the costs to the manufacturer. Separate material does not have to be used to create the sock portion. Plus the problem that St. Pierre's device improved, namely ill-fitting footies, will be solved more cost-efficiently by utilizing this present invention's hook and loop mechanism that is placed directly onto the one-piece garment. Because this mechanism grows with the child, the life of the garment is extended beyond that of the St. Pierre sock.

SUMMARY OF THE INVENTION

In these tough economic times, parents have to cut costs wherever possible in order to survive. One of the most expensive aspects of child rearing is the purchase of clothing, especially since the life of the clothes is based on fit rather than durability.

This invention improves the footed sleeping garment prevalently warn by toddlers. The footies keep little feet warm through the night while providing much needed traction while the child learns to toddle.

Feety Grow Sleepy extends the life of the garments by adjusting to the rapidly growing feet of the toddler. Since the foot grows faster than the rest of the body, many parents cut off the footies in order to extend the life of the garment. This drastically reduces the functionality of the garment and adversely affects durability since the cut ends become frayed, rolled, and unsightly.

By the use of an extension of the fabric on the bottom of the feet, a mechanism employing a hook and loop closure folds up over the toes and attaches to the tops of the feet so that it can adjust to the growing foot of the child. This will extend the life and functionality of the sleeping garment so that it could even be passed on to subsequent siblings.

DETAILED DESCRIPTION OF THE INVENTION

This invention provides a footed infant sleeper for a young toddler child, comprising a garment body including a pair of leg portions with enclosed footies that adjusts to the growing foot of the child.

As used herein, "footies" is defined as the plural of the term "footy," which is the portion of the garment that fully encloses the foot. The term "sleeper" is a garment that is used primarily when the wearer is sleeping. The term "garment" is an item of clothing. The term "hook" is a mobile device with teeth-like mechanisms that attaches to a loop. The term "loop" is a stationary device attached directly to the fabric that catches the teeth of the hook.

This invention further provides the above described footed sleeper, wherein said garment body and said footies are made of the same cloth, preferably a soft flame-retardant material, with an extension of that cloth under the toes so that it wraps upward to the top of the feet.

In an embodiment, the said cloth extension at the bottom of the feet attaches to the top of the feet via a hook and loop mechanism.

The invention also provides the above footed sleeper, wherein said hook and loop mechanism are comprised of one hook and one loop and attached directly to the fabric.

The invention further provides said attached mechanism is fully adjustable to accommodate the rapidly growing foot of the toddler child.

DESCRIPTION OF THE PREFERRED EMBODIMENTS

Figure 1:
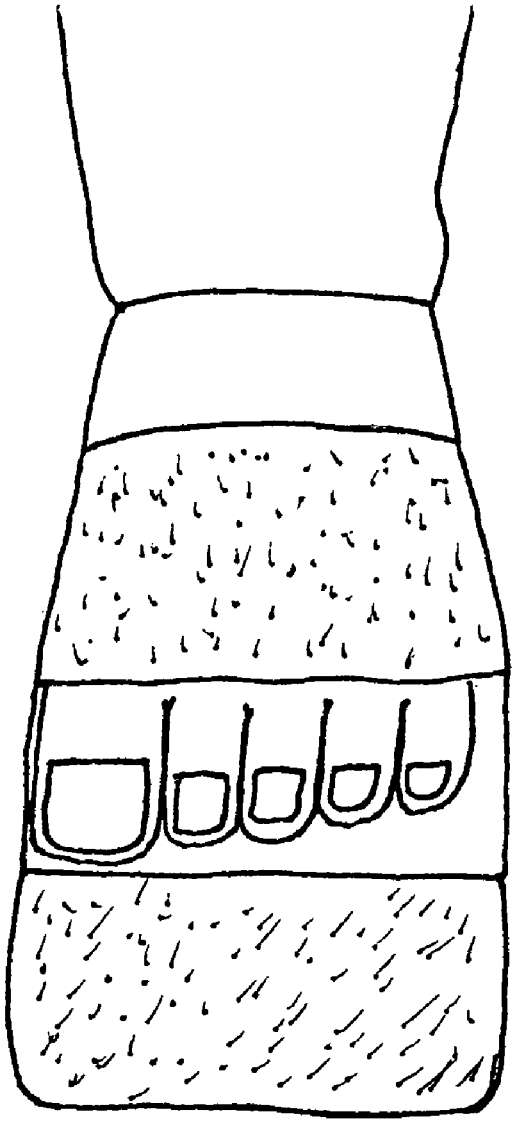
FIG. 1 is a full frontal view of the Feety Grow Sleepy with one footy open and one footy closed.
Figure 2:
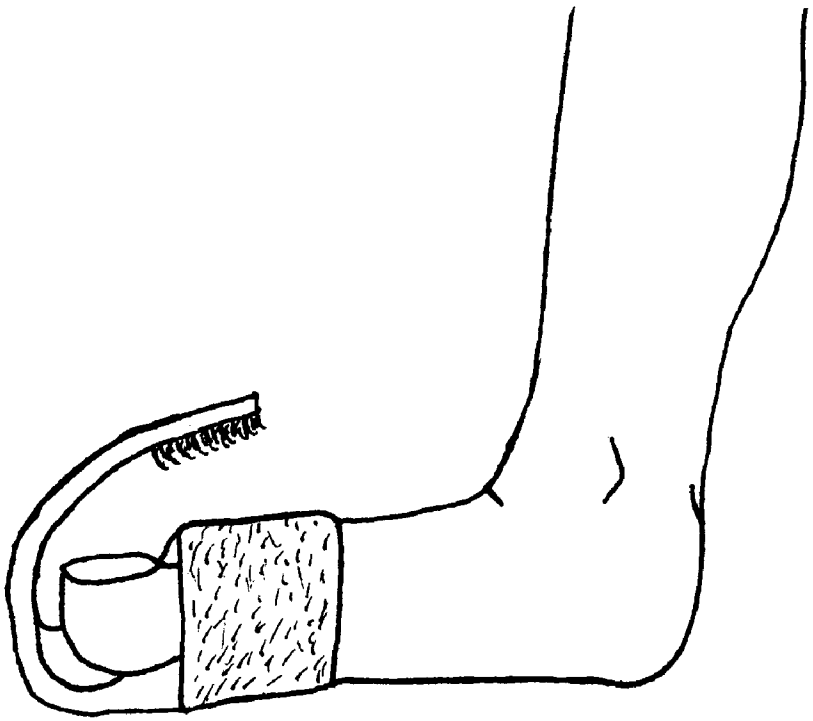
FIG. 2 is a full side view with the footy open.

Now referring to the drawings, and in particular to FIGS. 1 and 2, a footed sleeper embodying the elements of the present invention will be described. The footed sleeper, as shown in the front (FIG. 1) and side (FIG. 2) generally comprises a garment body (FIGS. 1 and 2) provided with a chest portion (FIGS. 1 and 2), a pair of arm portions (FIGS. 1 and 2) and a pair of leg portions (FIGS. 1 and 2) with attached footies (FIGS. 1 and 2) cooperating together to loosely cover the child's body, legs and arms.

The garment body (FIG. 1) is provided with a longitudinal opening (FIG. 1) closable by a zipper, series of snap fasteners, or the like. The body (FIG. 1) is preferably made of a relatively soft and porous fire-retardant fabric, which offers heat insulation, as well as breathability for the comfort of the child. The garment body (FIG. 1) could, for instance, be made of cotton, polyester or acrylic textile material.

Figure 3:
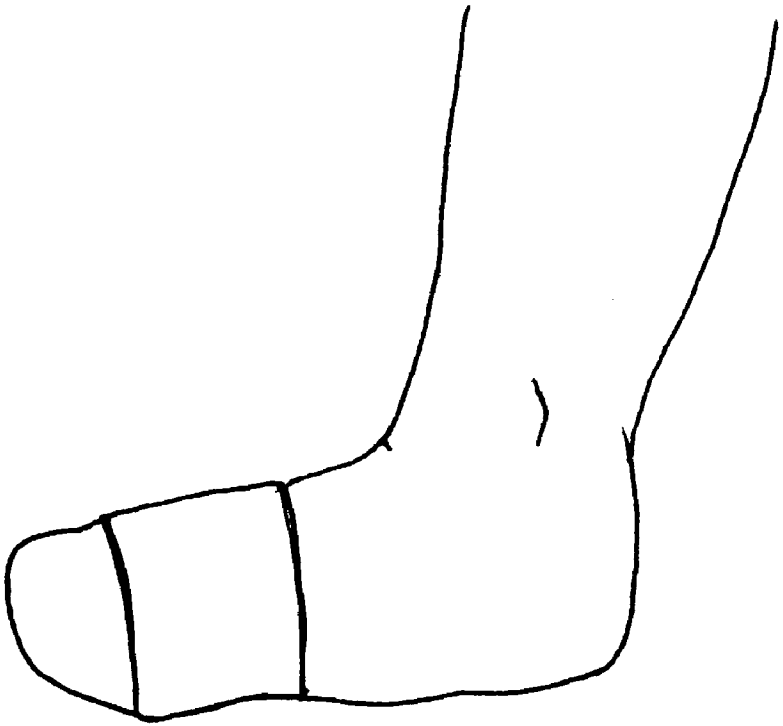
FIG. 3 is a close-up view of the open footy to show the hook and loop mechanism.

The leg portions (FIGS. 1 and 2) are integral to the chest portion (FIGS. 1 and 2) and terminate in tubular distal ends (FIGS. 1 and 2) sized to loosely surround the child's legs. A close-up view of the footies (FIG. 3) show how they are permanently connected to the distal ends (FIG. 3) with a hook (FIG. 3) attached on top of flap extension under the feet (FIG. 3), which will provide for adjustability by folding upward over the toes (FIG. 3) and attaching to a loop (FIG. 3) which is attached to the fabric directly on top of the feet (FIG. 3).

Figure 4:
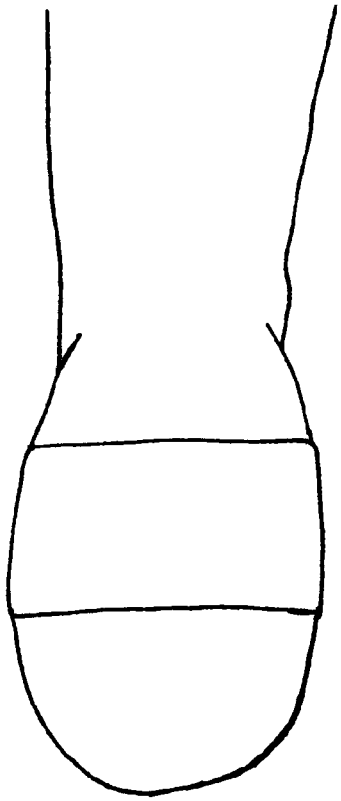
FIG. 4 is a view of the top of the footy closed.

With the footies closed (FIG. 4), the child's feet are enveloped by the fabric flap extension which keeps the child's feet warm. Since the flap is fully adjustable, the toes are never bunched and there is never any slack which may trip and injure the toddling child.

Figure 5:
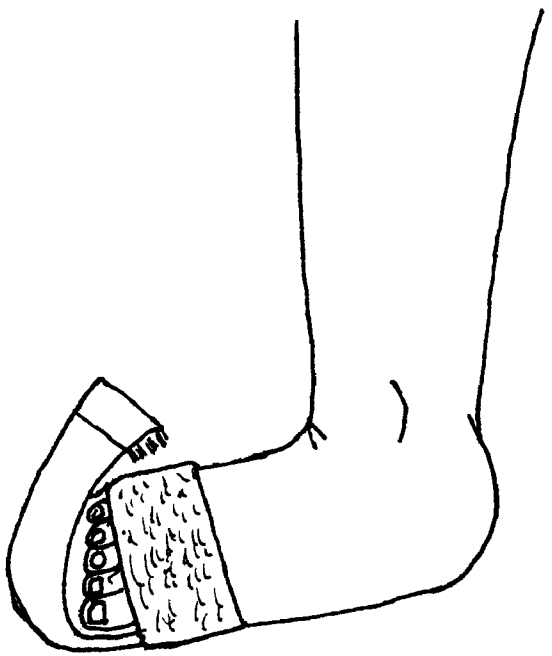
FIG. 5 is a side view of the folding of the hook onto the loop.

As shown in FIG. 5, the mechanism works to adjust for the rapidly growing foot by folding the fabric extension from the bottom of the foot (FIG. 5) over the toes (FIG. 5) and then fastening the hook that is attached to the extension (FIG. 5) onto the loop that is attached to the fabric on top of the foot (FIG. 5).

Figure 6:
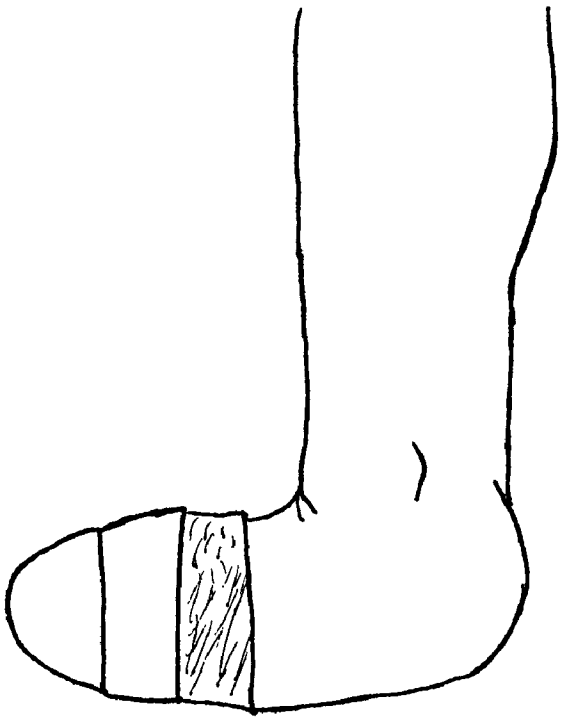
FIG. 6 is a side view of the adjustability of the hook and loop mechanism.
Figure 7:
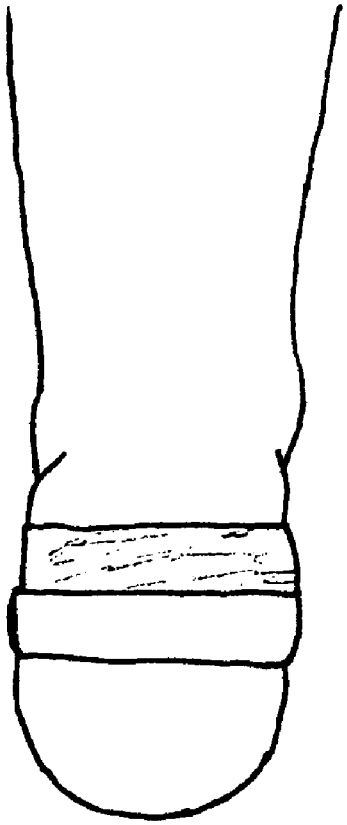
FIG. 7 is a top view of the adjustability of the hook and loop mechanism.
Figure 8:
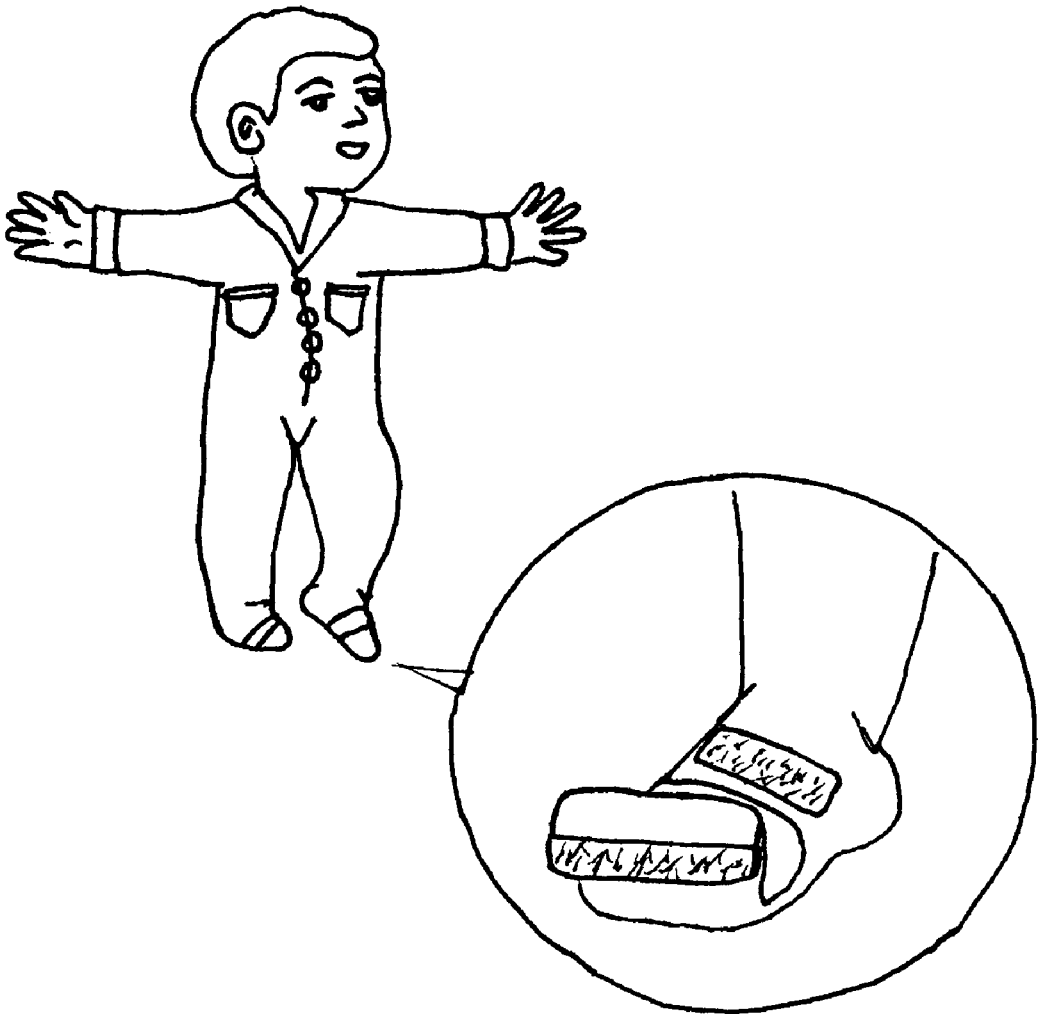
FIG. 8 is a view of the footed infant sleeper garment on a child.

The footed sleeper when closed, as shown in FIGS. 6 and 7, retains its functionality as the child grows. The mechanism fully adjusts to accommodate the rapidly growing foot, so parents no longer have to cut off the footies. This sleeper looks different and neater than a traditional one-piece sleeper with the footies cut off. This sleeper is also advantageous because it allows the foot to grow in the sleeper as the footies are fully adjustable, thereby allowing the toddler to wear the sleeper for a few years longer as the child grows. This invention is novel because it preserves the convenience, warmth, and functionality of a one-piece sleeper, and saves the family money as it can be passed down, fully intact, to subsequent siblings.

The invention claimed is:

1. A footed sleeper garment for a young child consisting of:

a one-piece body portion made out of a soft flame-retardant material having a pair of arm sleeves, a pair of leg portions, a pair of enclosed foot portions extending from said leg portions, a neck opening and a front opening extending downwards from the neck opening and having releasable fasteners;

said enclosed foot portions each comprising:

a top portion extending from a front of the leg portion along a top of the child's foot and having a terminal end adjacent to the child's toes, a continuous bottom portion extending from a back of the leg portion along a bottom of the child's foot and terminating in a flap portion having a terminal end, an adjustable opening formed between said terminal end of said top portion and said terminal end of said flap portion, the terminal end of the flap portion is folded up and around the child's toes to attach to the top portion closing the adjustable opening, a single rectangular hook and loop fastener attached to an exterior surface of the top portion adjacent to the terminal end and extending across a substantial width of the top portion, a single corresponding rectangular hook and loop fastener attached to an interior surface of the terminal end of the flap portion and extending across an entire width of the flap portion, the rectangular hook and loop fastener attached to said top portion having a greater length extending from the terminal end of the top portion towards the leg portion in comparison to a length of the said corresponding rectangular hook and loop fastener attached to the flap portion extending from the terminal end of the flap portion towards the leg portion, thereby allowing size adjustment of the enclosed foot portion to accommodate growth of the child's foot.

* * * * *